United States Patent [19]

Pensavecchia et al.

[11] Patent Number: 4,936,211

[45] Date of Patent: Jun. 26, 1990

[54] MULTICOLOR OFFSET PRESS WITH SEGMENTAL IMPRESSION CYLINDER GEAR

[75] Inventors: Frank G. Pensavecchia, Hudson; Richard A. Williams, Hampstead, both of N.H.; John P. Gardiner, Chelmsford, Mass.; Stephen M. LaPonsey, Merrimack; John F. Kline, Hudson, both of N.H.

[73] Assignee: Presstek, Inc., Hudson, N.H.

[21] Appl. No.: 234,474

[22] Filed: Aug. 19, 1988

[51] Int. Cl.[5] ..... B41F 7/10

[52] U.S. Cl. ..... 101/136; 101/177; 29/159.2

[58] Field of Search ..... 51/287; 101/137, 136, 101/140, 177, 174, 185, 467, 450.1, 175, 216, 217; 29/159.2

[56] References Cited

U.S. PATENT DOCUMENTS

| | | | |
|---|---|---|---|
| 367,024 | 7/1887 | Clark et al. | 101/174 |
| 517,907 | 4/1894 | Wendte | 101/174 |
| 786,274 | 4/1905 | Duff | 29/159.2 X |
| 1,075,575 | 10/1913 | Johnston | 101/136 |
| 1,635,299 | 7/1927 | Wohlrabe | 101/137 |
| 3,520,087 | 7/1970 | Kanai et al. | 51/287 X |
| 3,654,864 | 4/1972 | Ovshinsky | 101/467 |
| 3,678,852 | 7/1972 | Feinleib et al. | 101/467 X |
| 3,817,002 | 6/1974 | Carlson | 51/287 X |
| 4,082,902 | 4/1978 | Suzuki et al. | 101/467 X |
| 4,649,502 | 3/1987 | Keller et al. | 101/365 X |

FOREIGN PATENT DOCUMENTS

| | | | |
|---|---|---|---|
| 30994 | 3/1977 | Japan | 29/159.2 |

*Primary Examiner*—Clifford D. Crowder

*Attorney, Agent, or Firm*—Nutter, McClennen & Fish

[57] ABSTRACT

A low cost press able to print high quality continuous tone color copies comprises a single large diameter impression cylinder rotatably mounted to the machine frame. A plurality of print stations are spaced around the impression cylinder, each print station including a blanket cylinder in rolling contact with the impression cylinder and a plate cylinder in rolling contact with the blanket cylinder, the diameters of all of said plate and blanket cylinders being substantially the same and said impression cylinder having a diameter that is the same as or an even number more than the product of the plate cylinder diameter multiplied by the number of plate stations in the press. The cylinders are all rotatably coupled together by correspondingly sized gears so that they all rotate in unison with the impression cylinder gear being composed of arcuate parallel-cut segments having identical tooth profiles.

28 Claims, 3 Drawing Sheets

MULTICOLOR OFFSET PRESS WITH SEGMENTAL IMPRESSION CYLINDER GEAR

This invention relates to printing method and means. It relates more particularly to improved apparatus for printing high quality copies in color and to the printing method carried out by that apparatus.

BACKGROUND OF THE INVENTION

There are a variety of known ways to print hard copy. To name a few, the traditional techniques include rotogravure printing and offset lithography. Both of these printing methods require a plate which bears an image of the original document or picture to be copied and usually the plate is loaded onto a plate cylinder of a rotary press so that copies can be made efficiently. In the case of gravure printing, the plate cylinder is inked and the inked image thereon is impressed directly onto the paper or other copying medium. In the case of lithography, the image is present on a plate or mat as hydrophyllic and hydrophobic surface areas. Water tends to adhere to the water-receptive or hydrophyllic areas of the plate creating a thin film of water there which does not accept ink. The ink adheres to the hydrophobic areas of the plate. Those inked areas, usually corresponding to the printed areas of the original document (direct printing), are transferred to a relatively soft blanket cylinder and that, in turn, applies the image to the paper or other copying medium brought into contact with the surface of the blanket cylinder by an impression cylinder.

While certain aspects of the present invention are applicable to both kinds of printing and the approach can be applied to any number of colors including one as will be pointed out in more detail later, we will describe the invention in the context of a sheet-fed four-color offset press.

The plates for an offset press are usually produced photographically. In a typical negative-working subtractive process, the original document is photographed to produce a photographic negative. The negative is placed on an aluminum plate having a water-receptive oxide surface that is coated with a photopolymer. Upon being exposed to light through the negative, the areas of the coating that received light (corresponding to the dark or printed areas of the original) cures to a durable oleophyllic or ink-receptive state. The plate is then subjected to a developing process which removes the noncured areas of the coating that did not receive light (corresponding to the light or background areas of the original) and these non-cured areas become hydrophyllic (water loving). The resultant plate now carries a positive or direct image of the original document.

If a press is to print in more than one color, a separate printing plate corresponding to each color is required, each of which is usually made photographically as just described. In addition to preparing the appropriate plates for the different colors, the plates must be mounted properly on the plate cylinders in the press and the positions of the cylinders coordinated so that the color components printed by the different cylinders will be in register on the printed copies.

In most conventional presses, the printing stations required to print the different colors are arranged in a straight line or flatbed approach. Each such station contains all of the elements required to print a single color, including an impression cylinder, a blanket cylinder, a plate cylinder and the necessary ink and water systems for applying ink and water to the plate cylinder. The equaldiameter plate and blanket cylinders at each station are geared to the impression cylinder there and the latter is geared to the impression cylinders in the other stations so that all of the press cylinders rotate in unison to maintain registration of the different color components of each copy.

To make a copy on that type of press, a sheet of paper is fed to the first print station where its leading edge is gripped and the sheet wrapped around the impression cylinder at that station. The press then operates to print onto the sheet, say, the cyan color component of the original document being copied, after which that sheet is discharged to the second printing station of the press. At station No. 2, the leading edge of the sheet is picked up by a second gripper and wrapped around the impression cylinder of that station. The press then operates to print a second, e.g. the yellow, color component of the original document onto the paper sheet, after which the sheet is discharged to the third printing station which grabs the sheet and prints the third color component, i.e. magenta, onto the sheet. In four-color printing, the sheet passes through a fourth station which prints a black image onto the sheet. Thus, successive paper sheets are fed into the press, are printed on at the various print stations thereof, and then exit the press carrying a three or four-color image of the original document or picture.

A conventional press such as the one just described has several drawbacks. First of all, since it consists essentially of three or four single color presses arranged one after the other, it occupies a considerable amount of floor space. A present day four-color press of this type can be as long as 20 feet. Secondly, the sheet has to be picked up and wrapped around the impression cylinder at each print station of the press. Thus, in a four-color press, four separate operations are required to position the sheet for printing. This means that each printing station must have its own paper feeding and handling mechanisms. Not only does this increase the cost of the press, it also introduces print registration errors into the printed copies.

Normally in a press, misregistrations are corrected for by manually or automatically adjusting the relative positions of the plate cylinders at the various print stations in a proper rotational, axial, and skew-orientation phase. It has been proposed that by imaging the plates "on press" the time required to correct for misregistration will be substantially decreased. The imaging of the plates can be controlled by incoming image signals representing the original document to be copied or reproduced in high volume. Indeed, it has been proposed to image an offset plate on the press using an ink jetter. The ink jetter is controlled so as to deposit on the plate surface a thermoplastic imageforming resin or material which has a desired affinity for the printing ink being used to print the copies.

While that proposed system may be satisfactory for some applications, it is not always possible to provide thermoplastic image-forming material that is suitable for jetting and also has the desired affinity (phyllic or phobic) for the inks commonly used to make lithographic copies. Further, ink jet printers are generally unable to produce small enough ink dots to allow the production of smooth, continuous tones on the printed copies, i.e. the resolution is not high enough.

In any event, such manual, automatic or electronic registration correction procedures are not totally satisfactory for a sheet fed press because the registration errors due to the multiple grippings of each sheet are random errors that cannot be corrected completely by onetime adjustments of the plate cylinders or of the images thereon. Nor are such procedures effective to correct for misregistration due to random gearing errors caused by variations in the tooth profiles of the meshing gears that drive the various cylinders of the press. These tooth profile variations arise in the process of cutting the gears and they are more noticeable in large diameter gears.

Since such random errors are not normally correctable, press manufacturers have had to resort to minimizing the problem by using very accurate paper feeding mechanisms and precision gearing. Such precision parts are quite expensive and materially increase the overall cost of the press. Also, as alluded to above, the misregistration problem is not completely eliminated and can still manifest itself in a press intended to print high quality, high resolution copies, which is the type of press we are primarily concerned with here.

Thus, although considerable effort has been devoted to improving different aspects of printing, including lithographic printing, there still does not exist a compact, relatively low cost printing apparatus or press whose printing plates or cylinders can be formed right on the press using incoming digital data representing original documents or pictures to enable the printing in long or short runs of high quality continuous tone color reproductions or copies. It would, therefore, be highly desirable if such apparatus could be made available particularly as a relatively compact sheet fed press and at a cost affordable to printers and other businessmen who want to do high quality printing and publishing in-house.

SUMMARY OF THE INVENTION

Accordingly, it is an object of this invention to provide printing apparatus in the nature of a press which can print economically, in both long or short runs, high quality copies in black and white and in color.

Another object of the invention is to provide a press of this type whose printing plates can be imaged right in the press using image signals from any available source.

Another object of the invention is to provide an offset press which minimizes registration errors in the copies being printed.

Still another object of the invention is to provide printing apparatus of this type which compensates electronically and mechanically for registration errors that are introduced into the printing process.

Yet another object of the invention is to provide a sheet fed color press which prints in three or four colors using only a single impression cylinder thereby reducing the need to compensate for registration errors caused by page handoffs of the printed copies.

Still another object of the invention is to provide such printing apparatus which achieves complete computer control over the entire printing process, including plate generation, ink regulation and the start up, print, hold, shut down and cleanup stages of the actual printing operation.

Yet another object of the invention is to provide a method of color printing which minimizes registration errors in the printed impressions.

Other objects will, in part, be obvious and will, in part, appear hereinafter.

The invention accordingly comprises the several steps in the relation of one or more of such steps with respect to each of the others and the apparatus embodying the features of construction, combination of elements and arrangement of parts which are adapted to effects of steps, all as exemplified in the following detailed description, and the scope of the invention will be indicated in the claims.

Briefly, our printing apparatus is designed to accept electronic signals that represent color-separated images that are to be printed. It is implemented as a sheet-fed offset press. However, whereas prior presses of this type comprise a series of more-or-less self-contained print stations arranged one after another in a line, in our press, the print stations are disposed around a single large diameter impression cylinder, there being one station for each color. Thus, a four-color press has four offset print stations positioned around the impression cylinder, the stations all being similar to one another and the equal diameter plate and blanket cylinders therein being geared directly to the impression cylinder. When the press is operating, the paper sheets to be printed on are fed successively from a stack to the impression cylinder as that cylinder rotates. Circumferentially spaced clamping mechanisms on the cylinder grab successive fed sheets on the fly so that the sheets become wrapped and properly positioned around the impression cylinder and are advanced successively past print stations, in turn, so that each paper sheet is printed with a plurality of colors. The printed sheets are then stripped successively from the impression cylinder and stacked in a conventional manner.

To maximize the printing rate, the press is designed so that successive paper sheets are being printed by all of the print stations simultaneously. This means that the circumference of the impression cylinder must be large enough so that a number of paper sheets corresponding the number of print stations, e.g. four, can be wrapped around the cylinder at the same time. On the assumption that the plate cylinder at each print station is large enough to print a full-size image on one sheet of paper, this means that the diameter of the impression cylinder must be at least equal to the diameter of the plate cylinder multiplied by the number of print stations. In practice, the impression cylinder diameter can be larger than that product so that while the sheets are being printed at the four print stations, the press can also be in the process of loading a fresh sheet onto the impression cylinder and stripping a fully printed sheet from that cylinder. Thus, for a four color press, the diameter of the impression cylinder can be more than four times larger than the plate cylinder diameter. Actually, for reasons to be discussed presently, the two diameters should also differ by an even multiple. Thus, in a four color press, the impression cylinder should be exactly four, five, six, etc. times larger than the plate cylinder. In a three color press, the multiple would be three, four, five, etc.

It can be appreciated that there is a distinct advantage to arranging all of the print stations around a single large impression cylinder in that each sheet being printed on is clamped to the impression cylinder only once and is rotated past all four print stations before being released to the delivery end of the press. Since each sheet remains clamped on the impression cylinder during the entire printing process, there is less apt to be registration errors due to movement or mispositioning of the sheets. Also, the grouping of the print stations around a single impression cylinder materially reduces the floor space required by the press. Indeed, a press incorporating our invention requires only about one-third the linear floor space necessary to site a conventional four color offset press.

Each print station of our press includes equal-diameter plate and blanket cylinders and the usual ink and water systems that apply ink and water to the lithographic plate on the plate cylinder. Preferably, the ink system or fountain is of the type that permits automatic ink flow adjustment. The cylinders at all of the printing stations are geared directly to a unitary gear on the impression cylinder so that all of the cylinders rotate in unison. However, instead of being a unitary gear, this gear is specially constructed of five identical arcuate sections which are assembled on the impression cylinder to form a circular gear having essentially the same diameter as the impression cylinder. The gear thus divides the circumference of the impression cylinder into five arcuate printing sectors, (one for each of the four sheets being printed on and one extra to allow for loading and unloading sheets), each of which is equal to one printing period, i.e. one revolution of each plate cylinder. This means that if there are any gearing errors in the coupling of the plate and impression cylinders, the errors will be periodic around the circumference of the latter gear. Being non-random, those errors can now be corrected or compensated for by adjusting the relative phases of the plate cylinders or of the images thereon.

While the lithographic plates on the plate cylinders at the various print stations may be conventional ones, more preferably, they are of a type that can be imaged "on press" by imaging apparatus, e.g. lasers, at the print stations which respond to incoming image signals representing the respective color components of the original document or picture being printed by the stations. Such on-press imaging eliminates registration errors due to mispositioning of the plates on the plate cylinders. It also allows nonrandom or periodic color registration errors to be corrected automatically by electronically controlling the relative phases of the plate cylinders or the timing of the picture signals being applied to the imaging apparatus at the various print stations so that the images applied to the plates are shifted appropriately in phase. In the event that the printing plates are imaged on press by imaging apparatus at each print station, registration due to random gearing errors can be minimized further by proper placement of the imaging apparatus. More particularly, the imaging or writing head, e.g laser, spark discharge electrode, etc. should be positioned opposite the plate cylinder so that an image dot applied to that cylinder will offset to the impression cylinder or, more particularly, to a paper sheet thereon, after the plate cylinder has rotated exactly 360°. With this constraint, if there are any random gearing errors at any particular print station, these same errors will be repeated in each identical sector of the impression cylinder gear that defines a printing period or sector on that cylinder. Resultantly, the same image dot will offset to the impression cylinder at exactly the same location in each printing sector thereof. In effect then, the random gearing errors are rendered cyclical or periodic so that they can be compensated for electronically by appropriately controlling the timing of the signal applied to the imaging head that produces that image dot.

Preferably, our press includes a computer terminal or workstation which allows an operator to input data representing an original document or picture to be printed, as well as a keyboard to permit the operator to key in instructions regarding the particular press run, e.g. the number of copies to be printed, the number of colors in the printed copies, etc. The computer also allows complete control over the operating modes of the press including printing plate imaging (if applicable), press startup procedure, ink flow regulation, dampening, print, pause, as well as shutdown and clean-up sequences. Desirably also, the workstation includes a CRT display and the necessary internal memory to allow storage of the impression or image data so that the impression to be printed can be previewed before printing.

The press also includes provision for making ink adjustments automatically depending upon the actual number of dots of each color in different bands across the image, as opposed to the average number of color dots over the entire picture area. This provides very accurate control over ink usage and avoids the need of having a skilled technician present to effect the ink regulation manually. This also minimizes the amount of paper waste during set up.

A press made in accordance with this invention can print copies with as many as 1016×1016 dots/inch (pixels/inch), with each dot being as small as 1/2000 in.$^2$. The dots can be printed side by side or in an overlapping relation to produce smooth, continuous color tones in the printed copies. The press allows the printing of quick proofs as well as a large quantity of proofs in the event that distribution of same is required to a number of different people. If corrections are required, the corrections can be entered at the prepress workstation and new plates created reflecting the necessary changes. Then corrected copies can be printed on a small volume basis or in quantity. If unusually long print runs are required, e.g. in excess of 10,000 copies, new printing plates identical to the previous ones can be made from the data already stored on the press workstation. With all of these advantages, then, our press should find wide application wherever there is a need to print high quality color copies at reasonably low cost and with a great amount of flexibility in the printing operation.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
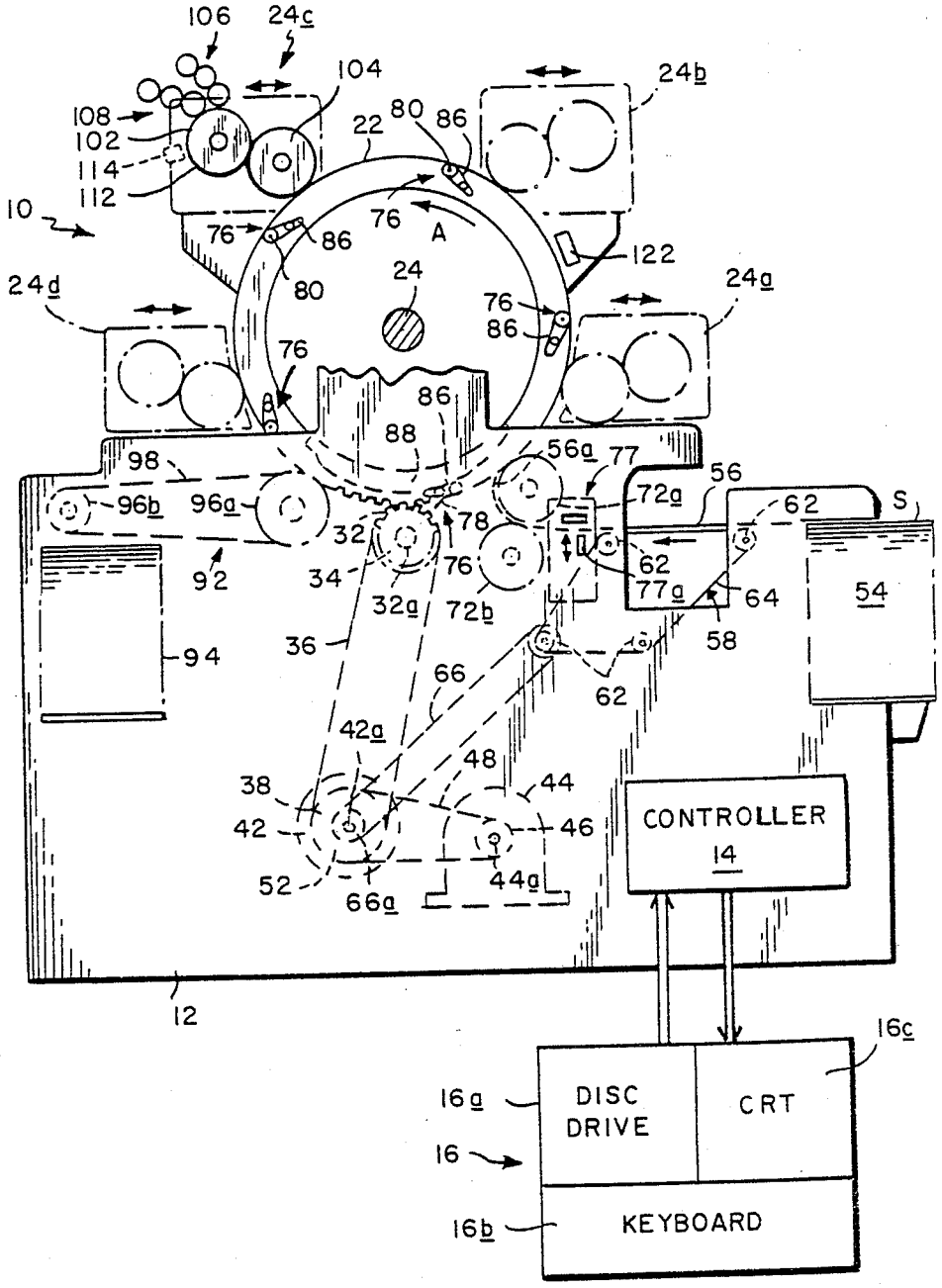
FIG. 1 is a side elevational view of an offset color press incorporating our invention.

Referring to FIG. 1 of the drawings, the illustrative embodiment of our press, shown generally at 10, is a freestanding, sheet-fed four-color offset press. The components of the press are mounted on an upstanding machine frame 12 which normally rests on the floor and is only about seven feet long. The press includes an internal controller 14 which receives input data and control signals from a separate workstation 16 connected to controller 14 by suitable cables. The press responds to digital signals representing an original document or image and since the press is a four color press, up to four separate strings of color signals are involved representing the color separations for cyan, yellow, magenta and black. These image signals may be stored on a disk and applied to the press by way of a disc drive 16*a* at workstation 16. Alternatively, they may arrive from a computer, telephone line or other source. Control signals for the press are entered by an operator via a keyboard 16*b* at the workstation. Using the keyboard, the operator may enter instructions for imaging the printing plates on press, e.g. instructions relating to press control such as ink flow adjustment, number of copies to be printed, etc.

Figure 2:
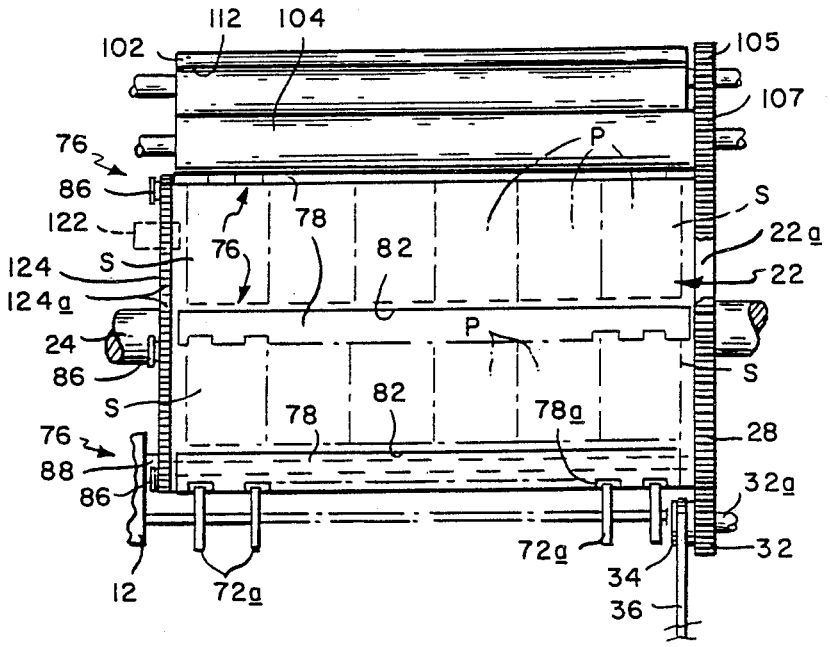
FIG. 2 is an end view of a portion of the FIG. 1 press.

Referring now to FIGS. 1 and 2, rotatively mounted on frame 12 is a large diameter impression cylinder 22 having a central axle 24 journaled in opposite sides of the machine frame 12. Typically, cylinder 22 is in the order of 94 inches in diameter. Disposed around cylinder 22 are four substantially identical print stations 24*a*, 24*b*, 24*c* and 24*d* which print the four colors cyan, yellow, magenta and black, respectively. Preferably the stations are supported by frame 12 as mirror image pairs on opposite sides of cylinder 22 as shown in FIG. 1.

Figure 3:
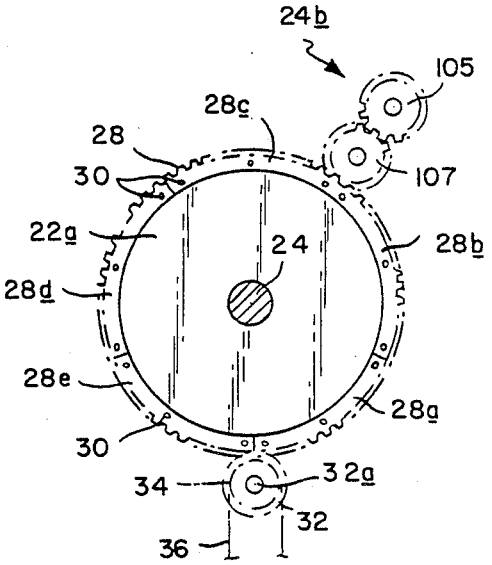
FIG. 3 is an elevational view showing the opposite or gear side of a portion of the FIG. 1 press.

As best seen in FIGS. 2 and 3, one end of cylinder 22 is milled to form a reduced diameter shoulder 22*a* on which seats a special circular gear 28 to be described in greater detail later. It suffices to say at this point that gear 28 is secured to the end of cylinder 22 by bolts 30 (FIG. 3) and it has substantially the same outer diameter as that cylinder. Meshing with gear 28 is a drive gear 32 rotatively mounted to the machine frame via the main drive shaft. Coaxially fixed to gear 32 is a pulley 34 which is connected by a belt 36 to a pulley 38 fixed to the output shaft 42*a* of a transmission 42 mounted at the bottom of frame 12. The transmission 42 is driven by an adjacent electric motor 44 having an output shaft 44*a* carrying a pulley 46 connected by a V-belt 48 to a pulley 52 on the input shaft (not shown) of transmission 42. In the illustrated press, cylinder 22 is rotated counterclockwise as shown by arrow A in FIG. 1.

Individual paper sheets S are fed to the impression cylinder 22 from a tray 54 at the righthand side of press 10 as viewed in FIG. 1. At appropriate points in the rotation of cylinder 22, while the cylinder continues to rotate, the topmost paper sheet S in tray 54 is picked from the stack and carried along a guide 56 leading towards cylinder 22 by a more or less conventional paper feeding mechanism or feeder shown generally at 58. The paper feeder 58 basically comprises an array of pulleys 62 mounted to the machine frame around which are trained one or more belts 64, the lowermost pulley 62 being rotated by a drive belt 66 which extends down to a pulley 66*a* on the output shaft 42*a* of transmission 42. The paper feeder 58, which may include picker fingers or suction means on each belt 64, picks up and carries each paper sheet S from tray 54 to the impression cylinder 22.

The paper feeder delivers the paper to a registration station shown generally at 77. At this station, the leading edge of the paper is stopped by vertically movable fingers 77*a* that register it to be parallel to the axis of the impression cylinder. Once this is done, the paper is moved toward a side guide (not shown), by any conventional means, to assure that it has been squared up and is in the correct axial position relative to the impression cylinder. Since this is a four color press, the registration accuracy required at this station is that required to allow printing on both sides of the page as opposed to the high precision required for color dot location.

Before each sheet S reaches impression cylinder 22, its leading end is guided by an upwardly curved lefthand end segment 56*a* of guide 56 through the nip of one or more pairs of upper and lower accelerating rollers or wheels 72*a* and 72*b*. These rollers are rotated by conventional means (not shown) so that their surface speeds exceed that of impression cylinder 22. Thus, just before it reaches the cylinder, the leading end segment of each sheet is accelerated upward directly toward the surface of cylinder 22.

As shown in FIGS. 1 and 2, cylinder 22 is provided with a circumferential array of paper clamping or gripping assemblies shown generally at 76. Each assembly 76 comprises an elongated gripper 78 which is rotatively mounted by pivots 80 at its opposite ends in a lengthwise slot 82 in cylinder 22. Each gripper is notched at 78*a* to provide clearance for wheels 72*a*. Also as best seen in FIG. 1, the pivot 80 at the lefthand end of gripper 78 extends through the adjacent end wall of slot 82 and is rotatably fixed to one end of a cam following lever 86 positioned adjacent to the lefthand end of cylinder 22. The opposite end of lever 86 is thus free to swing radially in and out. When the free end of each lever 86 is in its outer position as shown at the bottom of cylinder 22 in FIG. 1, the associated gripper 78 is in its open position as shown there so that it is able to receive or intercept the leading end of a paper sheet S. On the other hand, when the free end of each lever 86 in its radially inner position as shown at the top of cylinder 22 in FIG. 1, the associated gripper 78 is in its closed position wherein it lies flush against the surface of the cylinder.

Each gripper 78 is spring-biased toward its closed position and it is opened only when the associated lever 86 encounters an arcuate cam 88 fixedly mounted to frame 12 adjacent to the lefthand end of cylinder 22 as viewed in FIG. 2. The cam is located adjacent to a lower angular sector of the cylinder, (i.e. between 5 and 7 o'clock), so that when the cylinder is rotated to position one of the levers 86 opposite the cam, the associated gripper 78 is moved to its open position. Thus, before it is advanced opposite to the paper guide end segment 56*a* that gripper is ready to receive the leading end of the sheet S then being advanced by the paper feeder 58 to cylinder 22. Immediately thereafter, the lever 86 leaves the camming surface of cam 88 allowing gripper 78 to snap to its closed position thereby gripping that sheet so that the sheet becomes wrapped about the cylinder as that continues to rotate.

As shown in FIG. 1, the cylinder 22 in press 10 has five such gripping assemblies 76 distributed at equal angles around the cylinder. Each time a paper sheet S is fed to the cylinder and is gripped by a gripper 78, that entire sheet is advanced past all four print stations 24*a* to 24*d* before being released to a printed copy delivery station shown generally at 92 at the opposite side of the press below print station 24*d*. Conveyor 92 comprises a conventional mechanism for transporting paper sheet S from the surface of cylinder 22 to a receptacle 94 for printed copies. The conveyor is illustrated here as simply a pair of rollers 96*a*, and 96*b* carrying endless belts 98 which may support pickers or suction means (not shown) for pulling the trailing end of a sheet S from the surface of cylinder 22 after that sheet has been released by the lowermost gripper 78 opened by engagement of its lever 86 with cam 88, as shown at the bottom of cylinder 22 in FIG. 1.

Thus, press 10 is able to print on four successive paper sheets S simultaneously at the four print stations 24*a* to 24*d*, while a fifth fully printed sheet is being picked from the cylinder by the delivery station 92, and a fresh paper sheet is about to be loaded onto the cylinder by paper feeder 58. The press may include other known mechanisms such as paper guides, rollers, pickers, suction mechanisms, etc. to facilitate loading and offloading of the paper sheets. Actually, each sheet S may comprise of a number of document pages or image areas P as indicated in FIG. 2, the actual number depending upon the length of the press cylinders and the size of the image.

As mentioned previously, the print stations 24*a* to 24*d* are substantially identical. Therefore, we will describe only one of them, e.g. print station 24*c*, in detail. Station 24*c* comprises a plate cylinder 102 which makes surface contact with a blanket cylinder 104 of the same diameter, and that, in turn, is in surface contact with impression cylinder 22. More or less conventional ink and water systems 106 and 108, apply ink and water, respectively, to the surface of plate cylinder 102. Preferably, the ink fountain of the former system includes means for automatically controlling ink flow so that the amount and distribution of ink applied to the plate cylinder can be regulated by signals from press controller 14. One suitable fountain of this type is disclosed in U.S. Pat. No. 4,058,058. Preferably also, the print station 24*c* is slidably or pivotably mounted on machine frame 12 as shown by the double-headed arrows in FIG. 1 so that its blanket cylinder 104 can be moved into or out of contact with impression cylinder 22.

While certain aspects of the present invention can be incorporated into presses that have conventional print stations, most preferably, the print stations 24*a* to 24*d* of press 10 are the type described in U.S. Pat. No. 4,911,075, entitled LITHOGRAPHIC PLATES AND METHOD AND MEANS FOR IMAGING THEM, which patent has common ownership with the present application. Accordingly, the full disclosure in that justreferenced patent is hereby incorporated herein by reference. Suffice it to say at this point that the print station described there allows the imaging of a lithographic plate 112 by a scanning imaging or write head section 114 when the plate is mounted on the plate cylinder 102. While the write head section disclosed in that application is of the spark discharge type, it should be understood that for purposes of the present invention, the imaging means may be any type of device such as laser, stylus, electrode, etc. capable of imagewise exposing or otherwise altering the surface of plate 112 so as to impress an image on the plate in response to exposure signals applied to it by press controller 14.

The plate 112 carrying the image of the original document or picture to be copied is inked and dampened in the usual way by systems 106 at 108 and that inked image is transferred to the blanket cylinder 104 and from there to the paper sheets S wrapped around the impression cylinder 22. For certain types of lithographic plates 112, both water and ink from the systems 108 and 106, are coated onto the surface of the plates. Other types of plates 112 require no water from the water system 108 and accordingly, that system may be disabled or deactivated. Examples of such plates 112 used in so-called wet and dry lithography are described in the aforesaid application. In both types of lithography, however, the objective is to transfer an inked image from the plate cylinder 102 via the blanket cylinder 104 to the paper or other recording medium on impression cylinder 22.

As described previously, impression cylinder 22 is of a size to allow the four print stations 24*a* to 24*d* to print four different color images on four separate paper sheets S simultaneously. To accomplish this effectively and efficiently, it is essential that the relative positions of the images being printed on sheets S by the four print stations be precisely known and controlled. Otherwise, the four different color images printed on each sheet S will be out of register with respect to each other.

The fact that all of the sheets S are mounted on a single large impression cylinder while being printed on by all four print stations 24*a* to 24*d* contributes greatly to the ability of press 10 to print the different color components of each impression in register. This is because, as noted above, each paper sheet S is gripped at the surface of plate cylinder 22 only once. Therefore, the position of that sheet is fixed while the sheet is rotated into contact with the blanket cylinders 104 of all four print stations. Only then is the sheet released to the delivery station on 92. This is in sharp contrast to the situation in prior serial-type presses which grip and release each sheet at separate impression cylinders of the four print stations in the series. Obviously, such multiple gripping or handing off of each sheet can cause variations in the position of the sheet from station to station. These positional variations tend to be more or less random. Therefore, they are difficult to compensate for either mechanically or electronically. The usual solution has been to try to minimize the problem by resorting to complex and expensive feeding and positioning mechanisms at the various print stations. However, that solution is not feasible here where one of the prime objectives is to provide a relatively low cost press that can print high quality copies.

The use of a large impression cylinder 22 in press 10 produces an ancillary advantage in that the position or phase angle of cylinder 22 at any given time can be detected or monitored with a high degree of accuracy. In the illustrated press, this is accomplished by means of a magnetic detector 122 positioned on machine frame 12 opposite a large diameter steel strap or band 124 extending around the lefthand end of cylinder 22 as shown in FIG. 2. Band 24 has etched lines or makes 124*a* around its circumference. Detector 122 detects these marks and develops position signals which are applied to controller 14. The controller is thus able to monitor the angular position of impression cylinder 22 and, on the basis of that information, to control the timing of the various press functions. In the illustrated band 124, the marks 124*a* are spaced 0.008 inch apart. A phase lock oscillator in controller 14 divides the signals from detector 122 into eighty parts so that position signals are provided every 0.0001 inch or approximately every 0.0004 degree of rotation of cylinder 22. Since the blanket cylinders 104 and the plate cylinders 102 are all geared directly to the impression cylinder gear 28, the relative positions of those cylinders are also known to a high degree of accuracy.

Gear 28 is not simply of an arbitrarily large size, however. Rather, its diameter is related precisely to the diameters of gears 105 and 107 on the plate and blanket cylinder 102 and 104 respectively. More particularly, as noted previously, the impression cylinder 22 has at least as many paper sheet positioning or printing sectors as there are print stations; cylinder 22 actually has five such sectors, the extra one being for paper feed and let off as described above. In accordance with the present invention, gear 28 has a diameter that is exactly five times larger than the identical diameters of the plate and blanket cylinder gears 105 and 107. This means that gear 28 and the impression cylinder 22 can be divided into five printing periods or sectors, one for each sector on cylinder 22 at which a sheet S can be positioned for printing, the sectors being measured from sheet leading edge to leading edge. Furthermore, when gear 28 and cylinder 22 rotate through one printing period or sector, the plate and blanket cylinders 102 and 104 at the four printing stations will make one complete revolution to transfer complete images to the sheets S in the cylinder sectors opposite those respective stations. Theoretically then, after gear 28 has rotated through one printing period or sector, each plate and blanket cylinder gear 105 and 107 will have rotated exactly 360° to position their gear teeth at exactly the same positions vis a vis the next period of the impression cylinder gear 28 as they had at the beginning of the first period so that the positions of the inked images on the plate and blanket cylinders relative to paper sheets S on cylinder 22 will be the same for all printing periods.

In practice, however, this close relationship is usually not maintained due to gearing errors resulting from the cutting of the gears. In other words, when cutting or hobbing gears, particularly large diameter gears, the gear tooth profiles are not identical all around the gear. While these gearing inaccuracies may not be important in most applications, they are here where angular variations of the cylinders of as little as 0.0008 degree must be avoided. Furthermore, when the gearing errors arise in a satellitettype gearing arrangement of the type present in press 10, they give rise to print registration errors which are random in nature and, therefore, cannot be corrected or compensated for either mechanically or electronically. Until now, the only solution to this problem has been to provide costly precision gearing in color presses of this general type.

Figure 4:
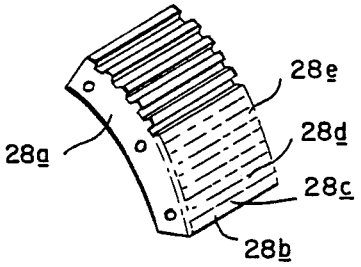
FIG. 4 is an isometric view illustrating the manufacture of the impression cylinder gear shown in FIG. 3.
Figure 5:
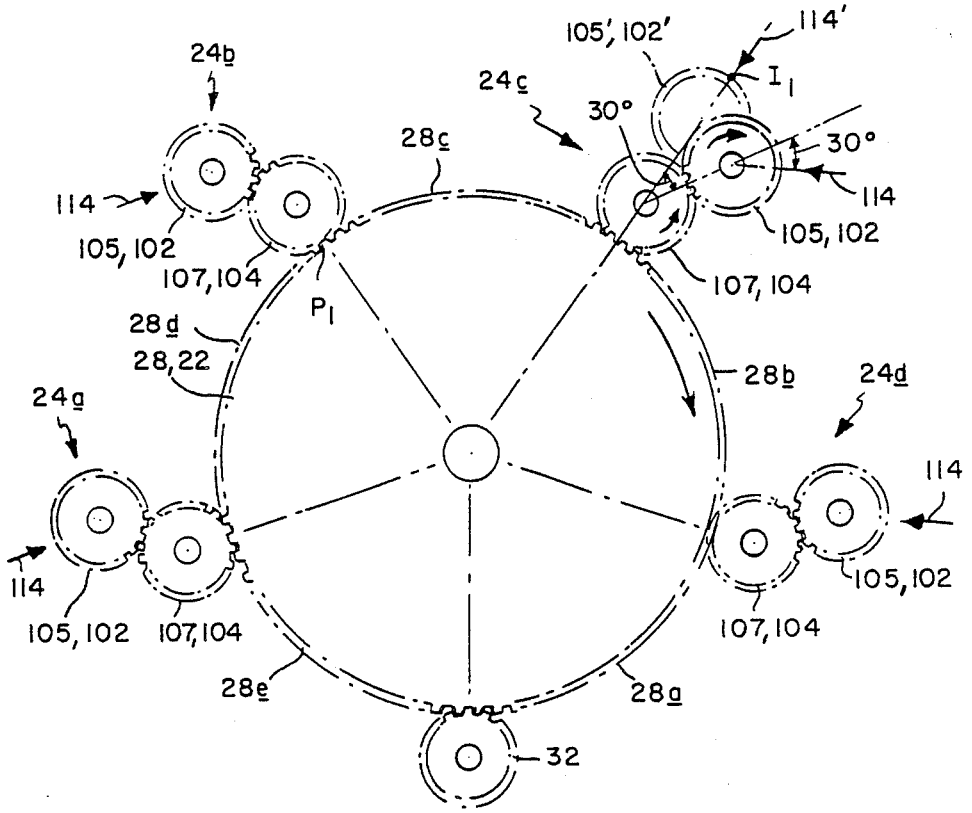
FIG. 5 is a diagrammatic view of the FIG. 3 gear side of the press illustrating the operation of the press.

Press 10 greatly reduces misregistration due to such gearing errors by making gear 28 as five identical arcuate segments **28*a* to 28*e*, one for each printing period, as shown in FIGS. 3 and 5. The gear segments 28*a* to 28*e* are made identical by stacking the segment blanks in parallel in the hobbing or gear cutting machine as shown in FIG. 4 so that the corresponding teeth of each gear segment are all cut simultaneously and therefore identically. Each gear segment is cut down the middle of the base of a tooth so that when the segments are assembled on cylinder shoulder 22*a* as in FIG. 3, they form a complete circular gear. After the gear segments have been angularly positioned properly on cylinder shoulder 22*a*, they are anchored tightly in place by bolts 30 which extend through holes in the gear segments and are threaded into the end of cylinder 22**.

The just described segmenting of gear 28 does not completely avoid all gearing errors in press 10. Rather, since the gear segments **28*a* to 28*e* are identical and since each such segment corresponds to one complete revolution of the plate and blanket cylinder gears 105 and 107, gearing errors that are present will repeat themselves during each printing period and will manifest themselves as cyclical or periodic registration errors in the printed copies. Those periodic gearing errors may be compensated for electronically when applying the images to the printing plates 112** as described in the above application.

When the plates 112 are imaged on press, the plate cylinder 102 and the write or imaging head 114 should be located relative to the impression cylinder 104 so that an image element or dot applied to the plate cylinder will arrive at the common tangent of the blanket cylinder and impression cylinder after the plate cylinder has rotated exactly 360°. In this way, that same dot will be handed off to the impression cylinder, or more particularly to a sheet S thereon, at exactly the same mechanical gearing point in each printing sector of cylinder 22. This aspect of registration correction can best be understood with reference to FIG. 5 which shows the angular relationships of the impression cylinder gear 28 and the plate and blanket cylinder gears 105 and 107 and the imaging head 114 at each print station **24*a* to 24*d*. Note that this figure, like FIG. 3, shows the side of the press opposite to the side shown in FIG. 1**.

Referring to print station **24*c*, if the plate cylinder gear 105, blanket cylinder gear 107 and the imaging head 114 were all arranged in a straight line on a radius of the impression cylinder gear 28 as shown in phantom at 102', 105', 114' in FIG. 5, an image dot I applied by head 114' to cylinder 102' would offset onto cylinder 22 or, more particularly, the paper sheet S thereon, after gears 105', 107 (and cylinders 102', 104) have rotated exactly 360° so that a printed spot $P_1$ would appear at exactly the same point in the following printing sector of cylinder 22. In other words, since the gear sectors 28*a* to 28*e*** are identical, identical gear teeth would be engaged during both the imaging and transferring times.

However, as a practical matter (when one considers packaging restraints), it may not be possible to provide such a straight line arrangement of cylinders and head 114 at each printing station **24*a* to 24*d*. Due to inking and dampening requirements and space constraints at each print station, the plate and blanket cylinders usually cannot both be positioned with their axes on a straight line from the center of the impression cylinder. However, if the imaging head 114 at each print station is positioned so that it has the same angular relationship to the line defined by the axes of the plate and blanket cylinder gears 105, 107 as that line has to the line defined by the center of the blanket and impression cylinder gears 107, 28**, any misregistration due to gearing errors at that print station will be exactly the same when printing in all of the printing periods or sectors of the impression cylinder.

In other words, the imaging head 114 should be angularly offset around the plate cylinder by the same amount that the axis of that cylinder is offset from the line extending from the center of the impression cylinder through the center of the blanket cylinder. In FIG. 5, this offset angle is shown (for example) as about 30° so that the imaging head 114 should be positioned with a 30° offset as shown. Since the print stations **24*a* to 24*d* are substantially identical, the other heads 114 are similarly offset 30° (in the opposite sense in the case of the mirror image stations 24*a* and 24*b***).

Cyclical mechanical errors that cannot be compensated for mechanically as aforesaid (i.e. axial misalignment and skew) can be compensated for electronically. More particularly, a dot position look-up table may be included in controller 14 which stores the x and y coordinates of all dot positions. By performing a so-called end-to-end test using plates imaged with simple test patterns (e.g. vertical and horizontal lines), copies are printed. If certain color lines deviate from the theoretical true position, the differences are measured and suitable x and y offsets are entered into the look-up table at the locations therein corresponding to the offending dots of the particular color. This calibration step would be performed only once at the factory during the final check-out phase of press manufacture and the corrected dot positions for each color permanently stored in the press controller as the pedigree for each of the four print stations. Subsequent similar calibration would be required only in the event that certain parts of the press, e.g. gearing, had to be replaced.

To operate press 10 in its imaging mode, the operator inserts a disk, tape, or any form of digital storage media carrying digital data representing the color separations of the original document to be copied and loads that data into the internal memory of the work station 16 and/or controller 14. The operator can then call up that data and preview the image on the display **16*c* before printing. Upon operator command, the controller 14 is caused to actuate the imaging heads 114 using that image data thereby applying corresponding images to the plates 112 on plate cylinders 102. The press can then be operated in its print mode to print proof copies of the original document, the number being determined by the operator's instructions entered via keyboard 16*b*. If the colors printed on the copies are acceptable, the operator can instruct the press to print the required number of final copies. If changes are required, new printing plates 112** can be made using appropriately corrected image data from the prepress system.

It is even feasible to make each plate cylinder 102 house a plate material cassette containing a length of imagable flexible mat or film that can be automatically advanced around the plate cylinder to locate fresh lengthwise segments of the mat or film on the cylinder surface. In this way, a plate 112 with a satisfactory and properly registered image can be created very quickly and efficiently. The old image will be rolled up inside of the plate cylinder at the same time as the new material is dispensed.

The operator can also regulate ink flow at each print station using keyboard **16*b* in the event that is deemed advisable from examining the printed copies in the course of a printing run. Further, the controller 14** can be programmed to automatically control the adjusting screws along each ink fountain doctor blade to set the screws in accordance with the amount of ink required across the image based on a count of the number of dots of each color to be printed in the band controlled by each adjusting screw.

Optionally, by addition of a densitometer, it is possible to achieve a fully automatic closed loop color adjusting system. The initial settings of the doctor blades may be based on a dot count done by the controller/computer as previously described. Using an "on the fly" color densitometer, the various colors (within the color bar) can be scanned, and the results fed back to the computer. The computer will compare the densitometer readings to the original dot count analysis and make new doctor blade adjustments, if needed. These steps can be repeated as many times as required. Once the process is completed, the data (per print station) can be stored as the pedigree of each and every color station. This color pedigree or fingerprint can then be used for the set up of the next printing job. By this approach, each successive job should come closer to final settings from the outset.

The controller is also programmed to automatically control the other usual press operations such as start up, shut down and clean-up.

It will thus be seen that the objects set forth above, among those made apparent from the preceding description, are efficiently attained and, since certain changes may be made in carrying out the above method and in the construction set forth without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention described herein.

What is claimed as new and desired to be secured by Letters Patent of the U.S. is:

1. Printing apparatus comprising a machine frame; a large diameter impression cylinder rotatably mounted to the frame; a plurality of print stations spaced around the impression cylinder, each said print station including a blanket cylinder rotatively mounted to the frame and in rolling contact with said impression cylinder and a plate cylinder rotatably mounted to the frame and in rolling contact with said blanket cylinder, the diameters of all of said plate and blanket cylinders being substantially the same and said impression cylinder having a diameter that is equal to or larger than the product of the plate cylinder diameter multiplied by an integer, and each cylinder including a correspondingly sized circular gear fixed coaxially to rotate with that cylinder, the blanket cylinder gear of each print station meshing with both the plate cylinder gear and the impression cylinder gear at that station, said impression cylinder gear being composed of a plurality of arcuate gear segments whose arc lengths are equal to the circumferences of the plate and blanket cylinder gears, the corresponding teeth of all of said impression cylinder gear segments having tooth profiles which are substantially indentical having been cut in parallel simultaneously by the same gear cutting tool so that gearing errors are periodic around the impression cylinder gear.

2. The printing apparatus defined in claim 1 wherein the impression cylinder diameter is an integer multiple of the plate cylinder diameter.

3. The printing apparatus defined in claim 2 wherein said integer is four or more and said rotating means rotates said impression cylinder.

4. The printing apparatus defined in claim 1 wherein the number of gear segments is the same as or an integer number more than the number of print stations.

5. The printing apparatus defined in claim 1 and further including means on the impression cylinder for releasably gripping the leading edge of a sheet, said gripping means being movable between gripping and releasing positions; means for feeding sheets one-by-one to said impression cylinder for gripping by the gripping means when the latter are in their releasing position; means for stripping each sheet from the impression cylinder when said gripping means are in their releasing position, and means for moving the gripping means between said two positions so that the gripping means are in their releasing position only over a relatively small selected sector of the angular motion of the impression cylinder that is not disposed opposite a print station whereby each fed sheet, upon being gripped by said gripping means, is wrapped about the impression cylinder and advanced past all of said print stations before being stripped from the impression cylinder by said stripping means.

6. The printing apparatus defined in claim 5 wherein said impression cylinder carries a plurality of said gripping means spaced around its circumference, the number of same being at least equal to the number of print stations in the press.

7. The printing apparatus defined in claim 6 wherein the number of gripping means is equal to the number of times that the impression cylinder diameter is longer than the plate cylinder diameter.

8. The printing apparatus defined in claim 1 wherein each print station also includes image receiving means on the surface of the plate cylinder thereat, and means for applying an image to the image receiving means at that station and further including means for receiving color separated electronic image signals representing the different color components of an original document and control means responsive to said signals for controlling the imaging means at each print station so that they apply a color separated image to the image receiving means on the plate cylinder at that station.

9. The printing apparatus defined in claim 8 wherein each said imaging means comprise a scanning energy source selected from the group consisting of laser, spark electrode and light emitter.

10. The printing apparatus defined in claim 8 wherein said control means process said signals to position each image on an image receiving means so as to compensate for said gearing errors that affect the angular position of each of said plate cylinders with respect to the impression cylinder.

11. The printing apparatus defined in claim 1 wherein each print station also includes an ink system for applying ink to said plate cylinder thereat, said ink system including means responsive to control signals for regulating the amount of ink applied to the corresponding plate cylinder along its length, and control means for providing control signals to said regulating means at each print station, said control means counting the number of image dots to be formed by each print station on selected portions of said plate cylinder and controlling said ink system for that print station based on the number of dots to be printed by that print station on said plate cylinder portions.

12. The printing apparatus defined in claim 11 and further including color densitomiter means for sensing colors in the printed matter printed by the printing apparatus, means for comparing the densitomiter means readings with the dot count for each print station to produce a color correction signal and means for applying said correction signal to said control means to readjust the number of dots to be printed by that station on said plate cylinder portions.

13. Printing apparatus comprising a machine frame; a relatively large diameter first cylinder rotatably mounted to the frame; a circular gear coaxially fixed to said first cylinder, said gear having a diameter that is substantially the same as that of the first cylinder and being composed of a plurality of separate arcuate segments, the corresponding teeth of all of said gear segments having substantially identical tooth profiles having been cut in parallel simultaneously by the same gear cutting tool, each said gear segment defining a printing sector of said first cylinder; a plurality of substantially identical second cylinders rotatably mounted to said frame in rolling contact with said first cylinder at spaced-apart locations around the first cylinder; a corresponding plurality of second cylinder gears coaxially fixed to said second cylinders, said second cylinder gears having the same diameter as said second cylinders and being in mesh with said circular gear, the arc length of each of said circular gear segments being equal to the circumferences of said second cylinder gears.

14. The printing apparatus defined in claim 13 wherein the number of gear segments is the same as or an integer number greater than the number of second cylinders.

15. The printing apparatus defined in claim 13 and further including a third cylinder rotatably mounted to said frame in rolling contact with a unique one of said second cylinders; a third gear coaxially fixed to each of said third cylinders, each said third gear having the same diameter as and being in mesh with, the second cylinder gears; means for rotating said first cylinder gear; imaging means movably positioned adjacent to each of said third cylinders to scan a raster on the surface of the corresponding third cylinder, and means for actuating each imaging means in response to color separated electronic image signals at selected points in the scan of said imaging means to apply a color separated image in the form of dots to the surface of the corresponding third cylinder.

16. The printing apparatus defined in claim 15 and further including means on the impression cylinder for releasably gripping the leading edge of a sheet, the number of gripping means being equal to the number of times that the impression cylinder diameter is longer than the plate cylinder diameter and each gripping means being movable between gripping and releasing positions.

17. The printing apparatus as defined in claim 15 and further including means for controlling the actuating means so as to compensate electronically for cyclical errors in the placements on copies of the half tone color dots printed by said printing apparatus.

18. Printing apparatus comprising a frame; a relatively large diameter first cylinder rotatably mounted to said frame; a first circular gear coaxially fixed to said first cylinder for rotation therewith, said first gear having essentially the same diameter as said first cylinder and being composed of a plurality of separate arcuate sectors the corresponding teeth of all of said sectors having identical tooth profiles having been cut in parallel simultaneously by the same gear cutting tool; at least one second cylinder rotatably mounted to said frame in rolling engagement with said first cylinder; at least one second circular gear coaxially fixed to said at least one second cylinder for rotation therewith, said at least one second gear having the same diameter as said at least one second cylinder and being in mesh with said at least one first gear; at least one imagable third cylinder rotatably mounted to said frame, said at least one imagable third cylinder having the same diameter as, and being in rolling engagement with, said at least one second cylinder and at least one third circular gear coaxially fixed to said at least one third cylinder for rotation therewith, said at least one third gear having the same diameter as, and being in mesh with, said at least one second gear, the arc length each of said first gear sectors being equal to the circumference of each of said at least one second and third gears.

19. The printing apparatus defined in claim 18 wherein there are a plurality of corresponding second and third cylinder and gear sets comprising separate print stations spaced around said first cylinder, the number of first gear segments being equal to or exceeding the number of print stations, each print station also includes an ink system for applying ink to said plate cylinder thereat, said ink system including means responsive to control signals for regulating the amount of ink applied to the corresponding plate cylinder along its length, and control means for providing control signals to said regulating means at each print station.

20. The printing apparatus defined in claim 18 and further including means for applying ink to the surface of each third cylinder and means responsive to ink control signals for adjusting each applying means to regulate the distribution of ink along each third cylinder, and control means for providing said ink control signals to each said adjusting means, said control means counting the number of image dots to be formed by each print station on selected portions of said third cylinder and controlling said adjusting means for that print station based on the number of dots to be printed by that print station on said third cylinder portions.

21. The printing apparatus defined in claim 20 and further including color densitomiter means for sensing colors in the printed matter printed by the printing apparatus, means for comparing the densitomiter means readings with the dot count for each print station to produce a color correction signal and means for applying said correction signal to said control means to readjust the number of dots to be printed by that station on said third cylinder portions.

22. The printing apparatus defined in claim 18 and further including means on said first cylinder for releasably gripping the leading edge of a sheet, the number of gripping means being equal to the number of times that said first cylinder diameter is longer than the plate cylinder diameter and each gripping means being movable between gripping and releasing positions.

23. The printing apparatus defined in claim 18 and further including imaging means responsive to image signals and positioned opposite each third cylinder for applying images thereto and control means for applying image signals to each said imaging means, said control means including a computerized work station for receiving and processing picture signals to develop said image signals.

24. Printing apparatus comprising a machine frame;

an impression cylinder rotatably mounted to the frame;

at least one print station positioned opposite the impression cylinder, each print station including a blanket cylinder rotatably mounted to the frame for rolling contact with the impression cylinder, a plate cylinder rotatably mounted to the frame for rolling contact with the blanket cylinder and means for applying image dots to a plate supported by the plate cylinder;

means for rotating said cylinders in unison;

means for applying ink to said plate;

ink regulating means responsive to ink control signals for regulating the amount of ink applied to the plate by the ink applying means at each print station; and control means responsive to picture signals for actuating the image applying means at each print station to form on said plate a corresponding image comprised of dots, said control means counting the number of image dots to be formed by each print station on selected portions of said plate and controlling the ink regulating means for that print station based on the number of dots to be printed by that print station on said plate portions.

25. The printing apparatus defined in claim 24 and further including color densitomiter means for sensing colors in the printed matter printed by the printing apparatus, means for comparing the densitomiter means readings with the dot count for each print station to produce a color correction signal and means for applying said correction signal to said control means to readjust the number of dots to be printed by that station on said plate portions.

26. Printing apparatus comprising a machine frame;

an impression cylinder rotatably mounted to the frame;

at least one print station positioned opposite the impression cylinder, each print station including equal diameter plate and blanket cylinders, rotatably mounted to said frame parallel to the impression cylinder and means for imaging a plate supported on the plate cylinder, said cylinders having correspondingly sized coaxial meshing gears for rotating said cylinders in unison, said impression cylinder gear being composed of a number of arcuate segments corresponding to the number of print stations, the arcuate length of each gear segment being equal to the circumferences of said plate and blanket cylinder; and means for rotating said cylinders.

27. Printing apparatus comprising a machine frame;

an impression cylinder rotatably mounted to the frame;

at least one print station positioned opposite the impression cylinder, each print station including equal diameter plate and blanket cylinders rotatably mounted to said frame parallel to the impression cylinder and means for imaging a plate supported on the plate cylinder, said cylinders having correspondingly sized coaxial meshing gears for rotating said cylinders in unison, said impression cylinder gear being composed of a number of arcuate segments corresponding to the number of print stations, the arcuate length of each gear segment being equal to the circumferences of said plate and blanket cylinder gears and said gear segments having corresponding teeth with substantially identical tooth profiles those teeth having been cut in parallel simultaneously by the same gear cutting tool; and means for rotating said cylinders.

28. Printing apparatus comprising a machine frame;

an impression cylinder rotatably mounted to the frame;

at least one print station positioned opposite the impression cylinder, each print station including equal diameter plate and blanket cylinders rotatably mounted to said frame parallel to the impression cylinder and means for imaging a plate supported on the plate cylinder, said cylinders having correspondingly sized coaxial meshing gears for rotating said cylinders in unison, said impression cylinder gear being composed of a number of arcuate segements corresponding to the number of print stations, the corresponding teeth of said gear segments having substantially identical tooth profiles having been cut in parallel simultaneously by the same gear cutting tool.

* * * * *